US008175495B2

(12) United States Patent
Oizumi

(10) Patent No.: US 8,175,495 B2
(45) Date of Patent: May 8, 2012

(54) POSITION REGULATION MEMBER AND TRANSPORT APPARATUS

(75) Inventor: Takao Oizumi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/962,935

(22) Filed: Dec. 8, 2010

(65) Prior Publication Data

US 2011/0140351 A1 Jun. 16, 2011

(30) Foreign Application Priority Data

Dec. 10, 2009 (JP) ..... 2009-280637

(51) Int. Cl.
*G03G 21/00* (2006.01)

(52) U.S. Cl. ..... 399/124

(58) Field of Classification Search ..... 399/121, 399/122, 124
See application file for complete search history.

(56) References Cited

U.S. PATENT DOCUMENTS

| | | | | |
|---|---|---|---|---|
| 5,802,426 | A * | 9/1998 | Miyazaki et al. | 399/113 |
| 7,330,682 | B2 * | 2/2008 | Shinshi | 399/122 |
| 7,424,249 | B2 * | 9/2008 | Koshida | 399/124 |
| 7,653,328 | B2 * | 1/2010 | Igarashi et al. | 399/124 |
| 7,684,731 | B2 * | 3/2010 | Hirose et al. | 399/124 |
| 7,979,000 | B2 * | 7/2011 | Sekina et al. | 399/121 |
| 2007/0147892 | A1 * | 6/2007 | Tomatsu et al. | 399/124 |
| 2010/0278557 | A1 * | 11/2010 | Somemiya et al. | 399/124 |
| 2011/0293326 | A1 * | 12/2011 | Tanabe et al. | 399/124 |

FOREIGN PATENT DOCUMENTS

JP 2005-066966 3/2005

* cited by examiner

*Primary Examiner* — Kaitlin Joerger
(74) *Attorney, Agent, or Firm* — Workman Nydegger

(57) ABSTRACT

A position regulation member, provided in one of a base unit and a removable unit that is attached to the base unit in a removable state, that positions the removable unit relative to the base unit, the positions regulation member including a position regulation arm provided so as to be mobile between a first position and a second position through the use of a cam mechanism, and a biasing spring attached to the position regulation arm. When the position regulation arm is moved from the first position to the second position or from the second position to the first position, the biasing spring biases the position regulation arm in the direction of the movement of the position regulation arm by first elastically deforming and then switch the direction of biasing by passing a inversion point.

6 Claims, 8 Drawing Sheets

POSITION REGULATION MEMBER AND TRANSPORT APPARATUS

BACKGROUND

1. Technical Field

The present invention relates to position regulation members and transport apparatuses.

2. Related Art

A large-format printer, which is an example of a recording apparatus, is configured to record by removing recording paper one sheet at a time from a paper supply cassette in which the recording paper (recording medium) is held in a stacked state and send that paper to a transport apparatus, after which the recording paper is transported to a recording unit by the transport apparatus.

With a system such as this, in which recording paper is transported one sheet at a time, there is the risk that so-called "skew", or the recording paper being sent slanted relative to the transport path, will occur. Paper jams can occur if paper is transported in a skewed state, especially when the skew is severe.

Accordingly, a recording apparatus that sets the recording medium with high precision in order to prevent the occurrence of such skew has been provided in the past (for example, see JP-A-2005-66966).

However, even if the recording medium can be set at high precision, it is extremely difficult to completely eliminate paper jams. Accordingly, with a large-format printer such as that mentioned earlier, the configuration is such that the area for transporting the recording medium is implemented as a unit so that when a paper jam has occurred, the area in which the paper jam has occurred can be easily accessed, and the medium path unit can be removed from the printer main body.

FIGS. 8A and 8B are diagrams illustrating an example of a past medium path unit configured so as to be removable as mentioned here, where FIG. 8A is a perspective view and FIG. 8B is a plan view. As shown in these diagrams, a medium path unit 60 includes a pair of shaft members 61 and 61, and the configuration is such that linking units 61*a* and 61*a* provided in the shaft members 61 and 61 so as to be able to protrude from and recede into the sides of the medium path unit 60. In other words, the pair of shaft members 61 and 61 are biased by a biasing member such as a spring (not shown) so that, as shown in FIGS. 8A and 8B, the linking units 61*a* and 61*a* protrude from the sides. Accordingly, when the medium path unit 60 is mounted in the printer main body (not shown), the linking units 61*a* and 61*a* interlock with concave portions for positioning (not shown) within the printer main body, and are thus anchored to a predetermined location within the printer main body.

On the other hand, when the medium path unit 60 mounted in the printer main body (not shown) in this manner is removed due to a paper jam or the like, tab portions 62 and 62 that are formed integrally with the pair of shaft members 61 and 61 are pushed inward by a user's fingers, moving the tab portions 62 and 62 in the direction of the arrows shown in FIG. 8B and causing the tab portions 62 and 62 to approach each other; as a result, the shaft members 61 and 61 are retracted, causing the linking units 61*a* and 61*a* to recede into the sides of the medium path unit 60. This releases the linking units 61*a* and 61*a* from their interlocked state with the concave portions, thus making it possible to remove the medium path unit 60 from the printer main body.

Incidentally, with a printer that includes the medium path unit 60, certain margins are maintained, due to manufacturing factors, for the positions of the shaft members 61 and 61 of the medium path unit 60, the positions of the concave portions for positioning, and so on, as is the case with printers in general. Accordingly, the medium path unit 60 is loose to a certain degree even when the linking units 61*a* and 61*a* of the shaft members 61 and 61 are interlocked with the concave portions and the medium path unit 60 is anchored.

This looseness may effectively cause skew to occur in the paper (medium) as a result, and is thus a factor in a drop in recording precision (printing precision).

Furthermore, with respect to the operations for removing the medium path unit 60 when a paper jam or the like has occurred, it is necessary to push the tab portions 62 and 62 together with one's fingers and pull the medium path unit 60 from the printer main body, which, being troublesome, has caused dissatisfaction.

SUMMARY

An advantage of some aspects of the invention is to provide a position regulation member capable of eliminating looseness and thus preventing problems stemming therefrom, and to provide a transport apparatus that includes such a position regulation member.

A position regulation member according to an aspect of the invention is a position regulation member, provided in one of a base unit and a removable unit that is attached to the base unit in a removable state, that positions the removable unit relative to the base unit, and includes a position regulation arm provided so as to be mobile between a first position and a second position through the use of a cam mechanism and a biasing spring attached to the position regulation arm; when the position regulation arm is moved from the first position to the second position or from the second position to the first position, the biasing spring biases the position regulation arm in the direction of the movement of the position regulation arm by first elastically deforming and then elastically restituting by passing an inversion point.

According to this position regulation member, the configuration is such that when the position regulation arm has been moved from the first position to the second position or from the second position to the first position, the biasing spring biases the position regulation arm in the direction of the movement; accordingly, by employing a configuration in which, for example, this position regulation member positions a medium path unit serving as the removable unit, the medium path unit is further biased by the biasing spring through the position regulation arm when positioned in the predetermined location, and is thus anchored to the predetermined location with no looseness.

In addition, when removing the medium path unit that is anchored to the predetermined location in this manner, the medium path unit can be removed simply by pulling the medium path unit out in the direction opposite to the direction in which the medium path unit was mounted. Furthermore, at this time, because the biasing spring is configured so as to bias the position regulation arm in the direction of the movement, the biasing spring biases the medium path unit in the direction in which the medium path unit is removed after the inversion point has been passed, and thus the medium path unit can be removed smoothly.

With the aforementioned position regulation member, it is preferable for the position regulation arm to include a pressure portion provided in the other of the base unit or the removable unit, the pressure portion having two branches that sandwich a pressure receiving portion.

Accordingly, the configuration is such that the removable unit is moved from the first position to the second position using one of the two branches of the pressure portion, and the removable unit is moved from the second position to the first position using the other of the two branches, thus enabling the removable unit to be advanced/retracted using a simple configuration.

With the aforementioned position regulation member, it is preferable for the cam mechanism to be configured so as to include two cams, each cam being configured of a cam groove and a boss that interlocks with the cam groove in a mobile state.

By doing so, the operation of the position regulation arm relative to an anchoring member is regulated by two cam pairs, and thus the level of freedom with which the position regulation arm moves is reduced, wasteful movement is eliminated, and the position regulation arm moves relative to the anchoring member as designed.

With the aforementioned position regulation member, it is preferable for one end of the biasing spring to be attached to the opposite side of the position regulation arm as the side that makes contact with the other of the base unit or the removable unit, and for the position regulation arm to be formed in a shape that is bent between the side that makes contact with the other of the base unit or the removable unit and the side to which the one end of the biasing spring is attached.

If the position regulation arm is bent in, for example, a "<" shape, the stroke of the position regulation arm on the side that makes contact with the other of the base unit and the removable unit can be increased while suppressing the overall movement range of the position regulation arm relative to the anchoring member. Accordingly, the size of the position regulation member can be reduced.

Meanwhile, a transport apparatus according to another aspect of the invention includes a medium path unit that is provided so as to be removable from a base member. The medium path unit is provided with a pressure receiving portion and a positioning unit that positions the medium path unit relative to the base member by making contact with a predetermined location of the base member, and the aforementioned position regulation member is provided in the base member; the position regulation member is disposed so as to press the pressure portion using the position regulation arm so that the first position and the second position correspond to a position in which the medium path unit is removed from the base member and a position in which the positioning unit is brought into contact with the predetermined location respectively.

According to this transport apparatus, the aforementioned position regulation member is provided in the base member, and thus the medium path unit can be anchored to the predetermined position without looseness, as mentioned earlier, and as a result, a drop in the recording precision (printing precision) on the recording medium can be suppressed.

Furthermore, the medium path unit can be removed smoothly and with ease simply by moving the medium path unit in the direction opposite to the direction in which the medium path unit is mounted.

With the transport apparatus, it is preferable for the pressure receiving portion to be disposed in the center of the medium path unit in the direction that is perpendicular to the transport direction of a medium.

Accordingly, because the center of the medium path unit is pressed in particular and anchored by the position regulation member, the central area in the width direction that is perpendicular to the transport direction of the recording medium held in the medium path unit is anchored, thus preventing skew in the recording medium discharged from the medium path unit with more certainty.

BRIEF DESCRIPTION OF THE DRAWINGS

The invention will be described with reference to the accompanying drawings, wherein like numbers reference like elements.

FIG. 5A is a perspective view and FIG. 5B is a front view.

FIG. 6A is a perspective view and FIG. 6B is a back view.

DESCRIPTION OF EXEMPLARY EMBODIMENTS

Figure 1:
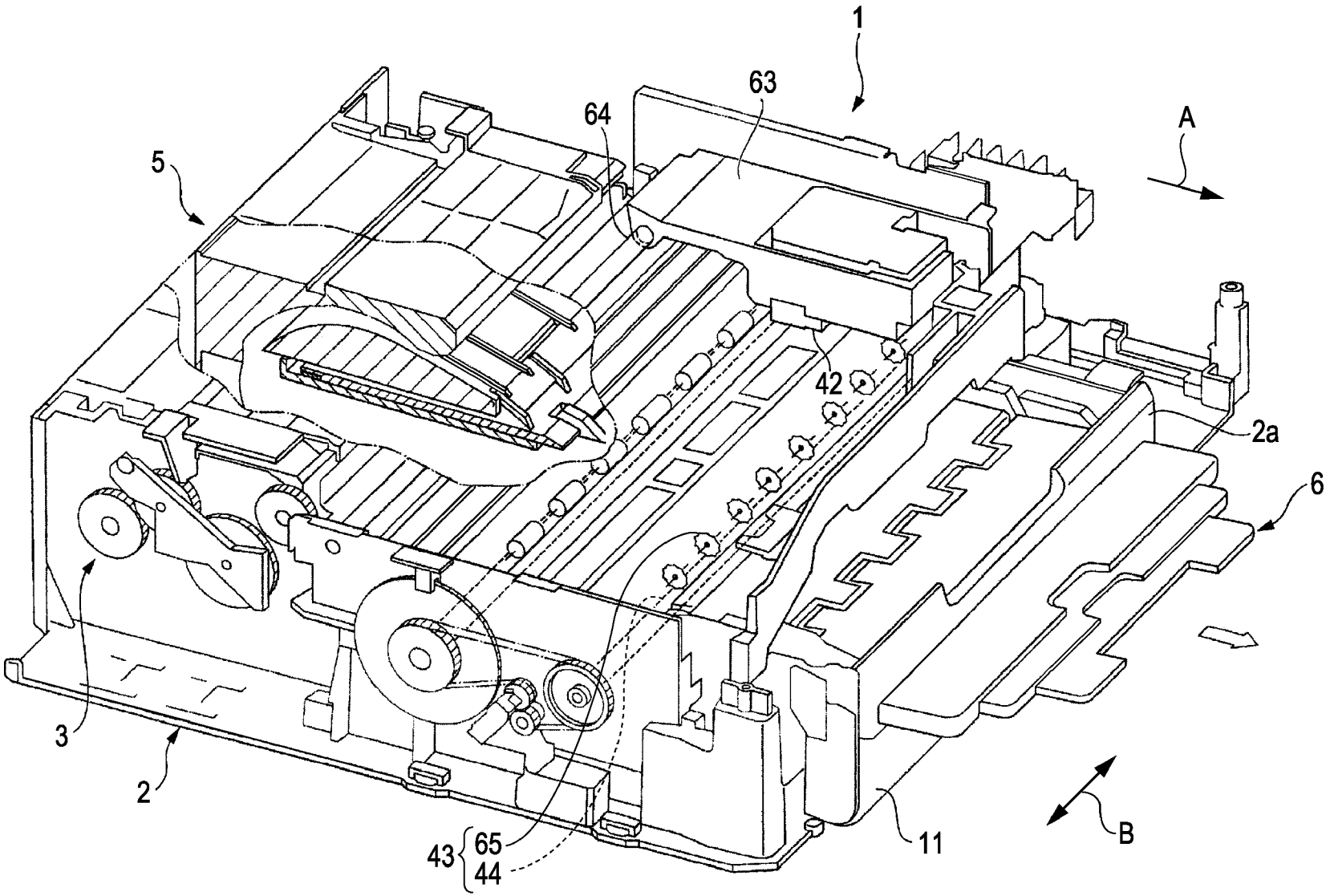
FIG. 1 is a diagram illustrating the overall configuration of an exemplary printer that includes a transport apparatus according to the invention.

Hereinafter, an embodiment of the invention will be described with reference to the drawings. FIG. 1 is a diagram illustrating the overall configuration of an exemplary printer (recording apparatus) that includes a transport apparatus according to the invention, where the numeral 1 in FIG. 1 indicates the printer.

Figure 2:
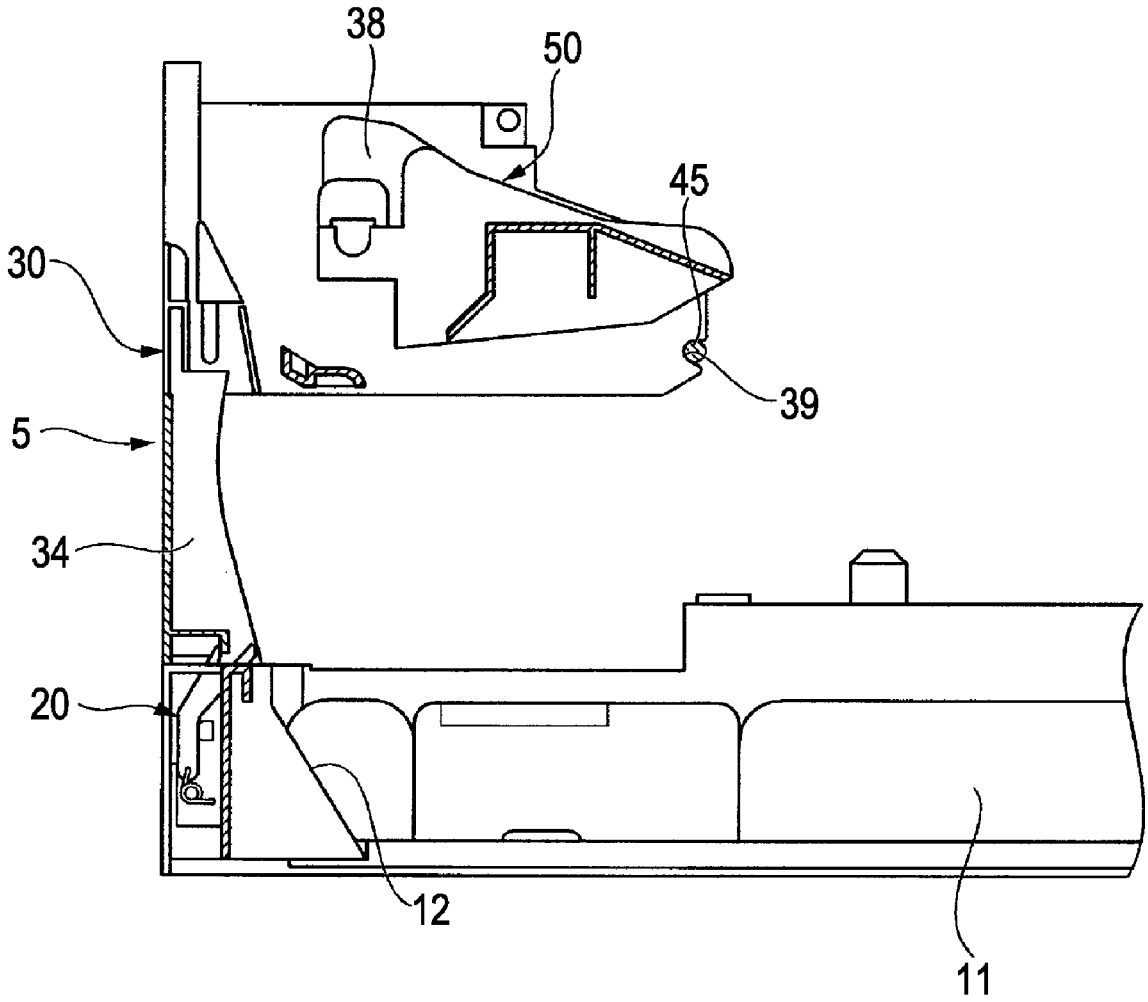
FIG. 2 is a cross-sectional view illustrating the overall configuration of the internal structural elements of the printer illustrated in FIG. 1, as seen from the side.

FIG. 1 is a perspective view illustrating the internal structure of the printer 1, whereas FIG. 2 is a cross-sectional view illustrating the overall configuration of the internal structural elements of the printer 1 illustrated in FIG. 1, as seen from the side.

The printer 1 is a serial printer in which a recording head 42 is mounted in the bottom surface of a carriage 63 that moves back and forth, in a width direction B that intersects with a transport direction A, in a recording execution region where recording is performed on recording paper (a recording medium).

The printer 1 is configured so as to include a rectangular box-shaped printer main body (base unit or base member) 2 whose outside is formed of comparatively flat surfaces. A paper feed cassette 11 in which multiple sheets of recording paper are held in a stacked state is mounted so as to be removable in the bottom center of a front surface 2*a* of the printer main body 2.

Although only one level is included in the paper feed cassette 11 shown in FIG. 1, the structure may of course be such that multiple levels are provided. Furthermore, operational buttons (not shown) for executing various types of operational commands, a cartridge holder (not shown) for holding various types of ink cartridges, and so on are provided in the front surface 2*a* of the printer main body 2 in areas aside from where the paper feed cassette 11 is mounted.

The recording paper held in the paper feed cassette 11 is fed out one sheet at a time starting with the uppermost sheet using an automatic feed device 3, after which the recording paper is fed toward an inverting path 50 in a transport apparatus 5 indicated in FIG. 2. Here, the transport apparatus 5 is configured so as to include a medium path unit 30 mounted in the printer main body 2 in a removable state, thus forming the inverting path 50. Note that the medium path unit 30 will be discussed later.

The automatic feed device 3 is configured so as to include a pickup roller (not shown) that pulls the uppermost recording paper in the paper feed cassette 11 rearward, a separating surface 12 that leads the uppermost recording paper that has been pulled rearward toward the inverting path 50 while separating that paper from the rest of the paper in preparation, a guide roller (not shown) provided above and behind the separating surface 12 in a freely-rotatable state, and a separating roller provided above and behind the guide roller.

The pickup roller presses on the top surface of the recording medium during feeding, and pulls the uppermost recording medium in the paper feed cassette 11 rearward by rotating in the transport direction A. The separating roller is configured of a pair of nip rollers that include a separating slave roller (not shown) connected to a torque limiter and a separating driving roller, and realizes the primary separation effect by which the following recording media that could not be separated through the preparatory separation performed by the separating surface 12 is completely separated from the uppermost recording medium.

The recording medium fed by the automatic feed device 3 is transported within the inverting path 50 and led to a recording position (not shown). As shown in FIG. 1, the recording head 42 and the carriage 63, which can move back and forth in the width direction B with the recording head 42 mounted on the bottom surface thereof and while being guided by a carriage guide shaft 64, are provided at the recording position. The recording head 42 includes multiple ink tubes and ink supply pumps (not shown) that supply ink of various colors, a capping device (not shown) provided at a home position of the carriage 63, and so on.

Meanwhile, a recording medium discharge unit 6 is provided in a position that is downstream from the recording position in the transport direction A. The discharge unit 6 is configured so as to include discharge rollers 43 configured of a pair of nip rollers that includes a discharge driving roller 44 and a discharge slave roller 65.

The transport apparatus 5 in the printer 1 configured in this manner includes, as mentioned earlier, the medium path unit 30; the recording medium that has been fed out from the paper feed cassette 11 and risen along the separating surface 12 due to the guide roller, separating roller, and so on moves along the inverting path 50 and is further transported toward the recording position.

Figure 3:
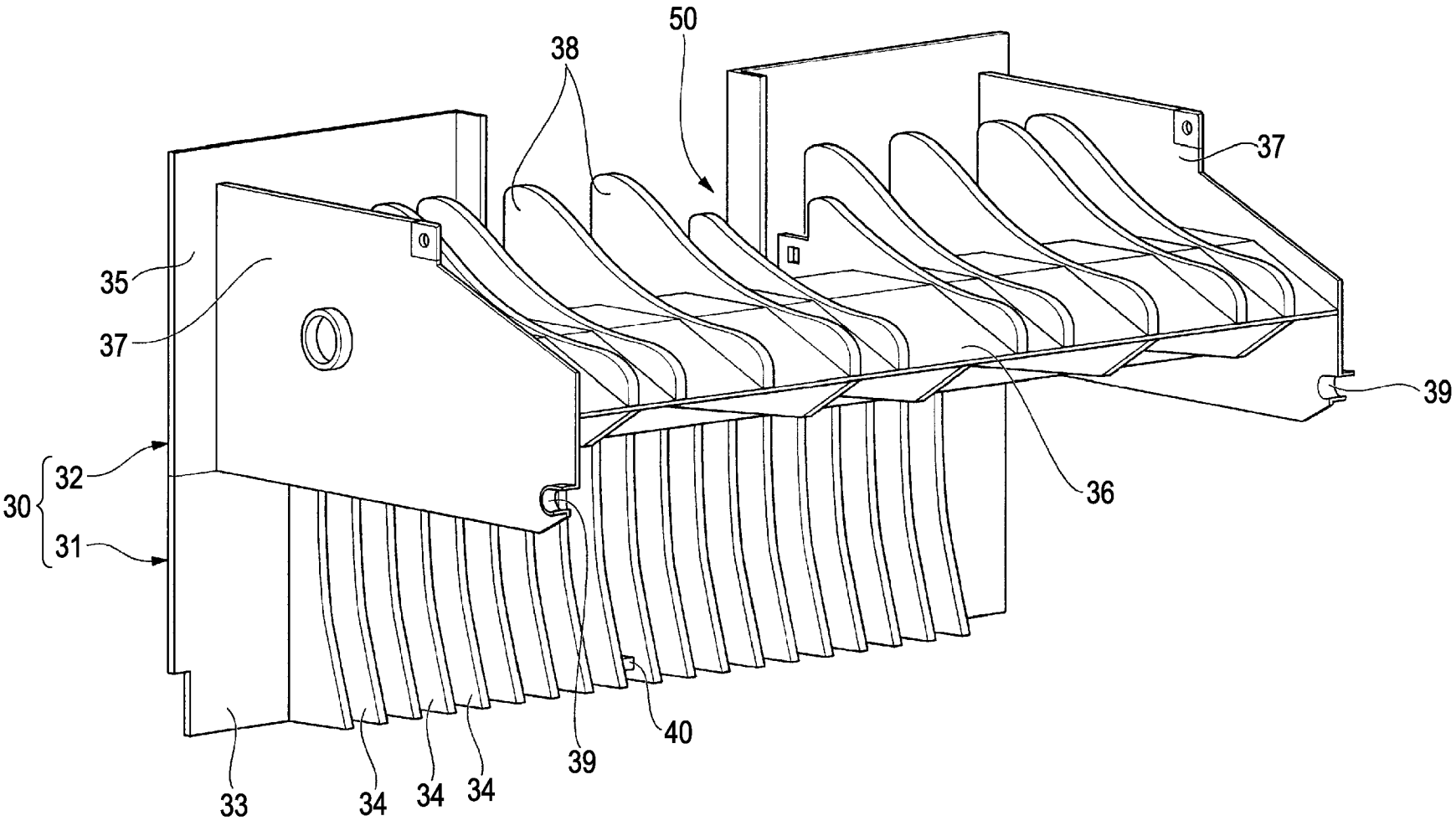
FIG. 3 is a perspective view of a medium path unit.

The medium path unit 30 is housed in a housing unit (not shown) of the printer main body 2, and as illustrated in the perspective view in FIG. 3, is configured of a unit bottom portion 31 and a unit top portion 32 that are fastened to each other using screws (not shown), thus creating a single integrated entity. The unit bottom portion 31 is configured so as to include a substrate 33 and guide plates 34 provided on one surface (an inner surface) of the substrate 33. The guide plates 34 are formed extending in the vertical direction, with multiple guide plates 34 arranged in the horizontal direction parallel to each other and the inner side surfaces of each of the guide plates 34 being formed in a curved shape; the guide plates 34 are for guiding the recording medium that has risen along the separating surface 12 in the upward direction, as shown in FIG. 2.

The unit top portion 32 illustrated in FIG. 3 is configured so as to have a substrate 35 that connects to the substrate 33 of the unit bottom portion 31 and a transport plate 36 of which the inverting path 50 is formed. A pair of side plates 37 and 37 is provided on both sides of the inner surface of the substrate 35, and the transport plate 36 is provided between the side plates 37 and 37. A gap is provided between the substrate 35 and the transport plate 36, and as a result, the recording medium that has risen along the inner side end surfaces of the guide plates 34 in the unit bottom portion 31 is guided by guide rollers and the like (not shown), passes through the gap, and is fed to the top of the transport plate 36.

Guide plates 38 are formed on the top surface of the transport plate 36, with multiple guide plates 38 arranged parallel to each other and extending in the horizontal direction (transport direction), which is perpendicular to the direction in which the guide plates 38 are arranged. A predetermined curve shape is formed in the upper end surfaces of the guide plates 38, and the inverting path 50 is formed by these upper end surfaces.

In addition, positioning concave portions (positioning portions) 39 are formed in the respective end areas of the side plates 37 and 37. As shown in FIG. 2, these positioning concave portions 39 make contact and interlock with positioning members 45 provided in two predetermined locations in the printer main body (base body) 2, and as will be described later, when the medium path unit 30 is mounted in the printer main body 2, the positioning concave portions 39 make contact and interlock with the positioning members 45, thus positioning the medium path unit 30 relative to the printer main body 2.

Figure 4B:
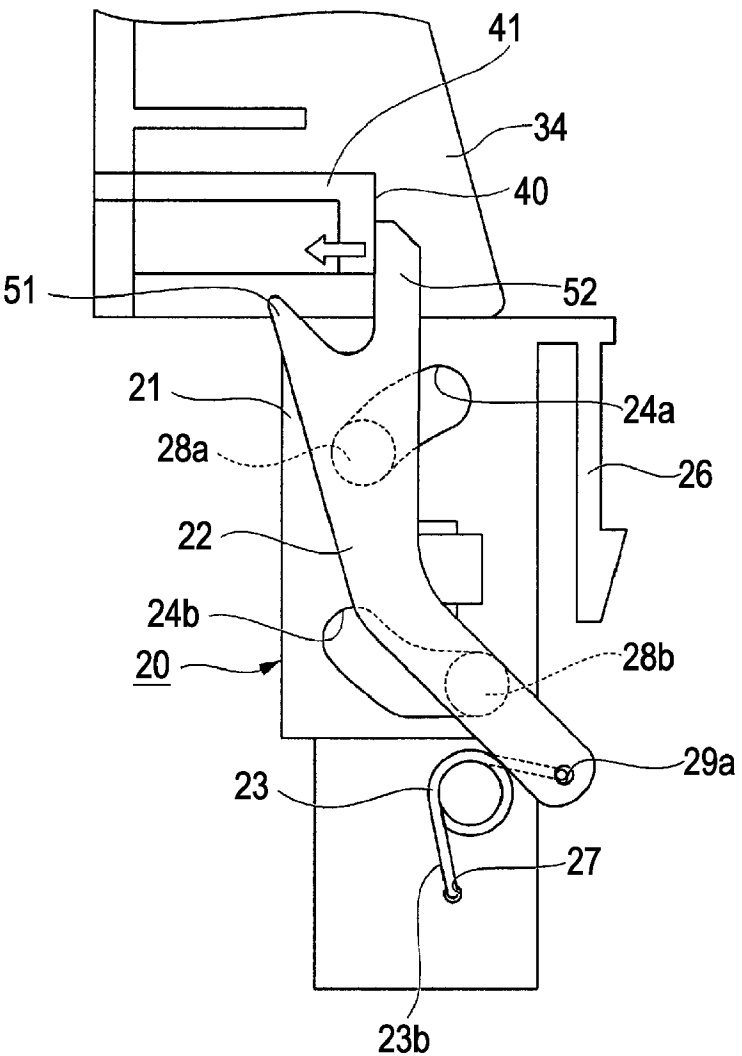
FIGS. 4A and 4B are cross-sectional views illustrating a unit bottom portion and a position regulation member from the side.
Figure 4A:
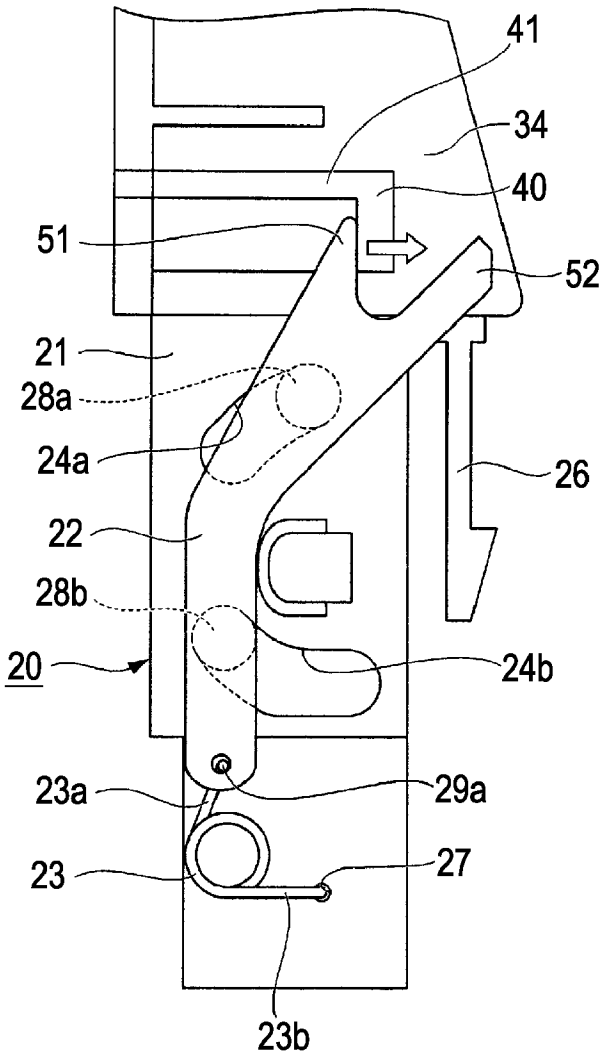

In addition, a pressure receiving portion 40, which interlocks with and is depressed by a position regulation member 20 according to the invention, is formed in the medium path unit 30, in the lower central portion of the unit bottom portion 31. The pressure receiving portion 40 is formed of a plate member in which the end area of a side plate 41 provided in the bottom area between the guide plates 34 that are arranged parallel to each other is curved in a downward direction, as illustrated in FIGS. 4A and 4B, which are cross-sectional views showing the lower central portion of the unit bottom portion 31 from the side.

The pressure receiving portion 40 is depressed in the advancing/receding (forward/backward) direction and is biased by the position regulation member 20. The position regulation member 20 serves as an embodiment of the position regulation member according to the invention, and is provided in the printer main body (base unit) 2 so that the medium path unit (removable unit) 30 can be positioned relative to the printer main body 2.

The position regulation member 20 includes an anchoring member 21, a position regulation arm 22 provided so as to be capable of moving between a first position and a second position relative to the anchoring member 21 through the use of a cam mechanism, and a biasing spring 23 attached between the anchoring member 21 and the position regulation arm 22.

Figure 5A:
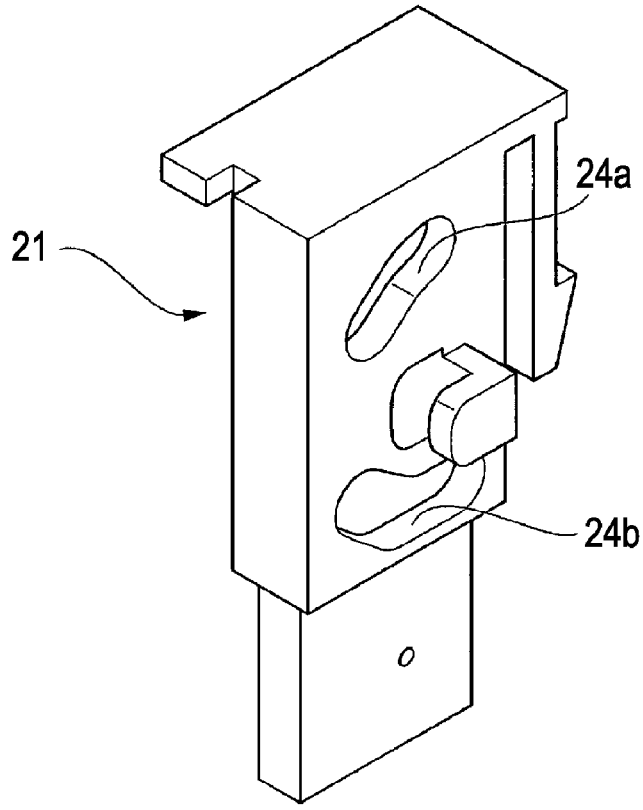
FIGS. 5A and 5B are diagrams illustrating the configuration of an anchoring member, where
Figure 5B:
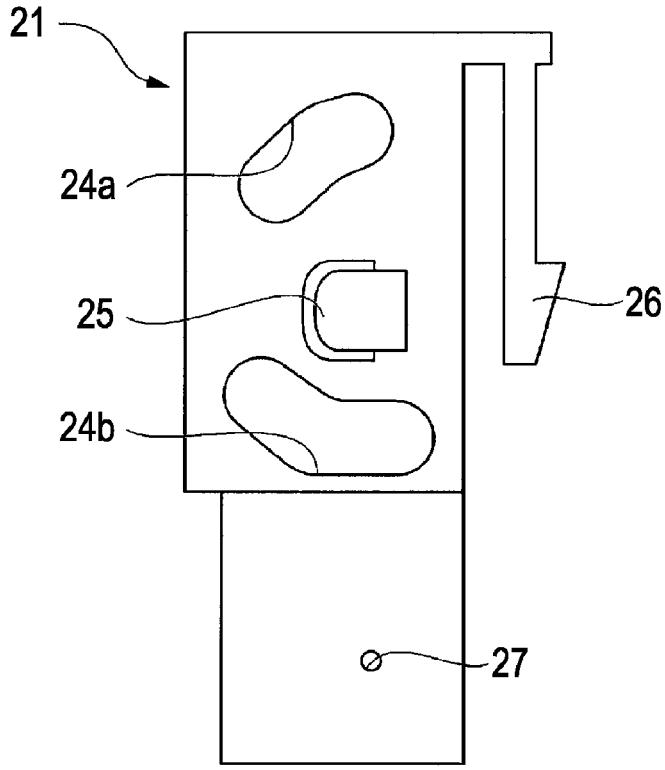

The anchoring member 21 is a plate-shaped member that has, as shown in FIGS. 5A and 5B, two cam grooves 24*a* and 24*b* are formed in the upper portion of one of the side surfaces of the anchoring member 21, and a holding portion 25 for holding the position regulation arm 22 is formed between the cam grooves 24*a* and 24*b*; an attachment interlocking protrusion 26 is formed in the side of the anchoring member 21, and an attachment hole 27 for attaching one end of the biasing spring 23 is formed further below in the anchoring member 21. Note that the lower area in which the attachment hole 27 is formed so that its surface is lower than the surface of the upper area in which the cam grooves 24*a* and 24*b* are formed, and thus a step is formed between those two areas.

Figure 6A:
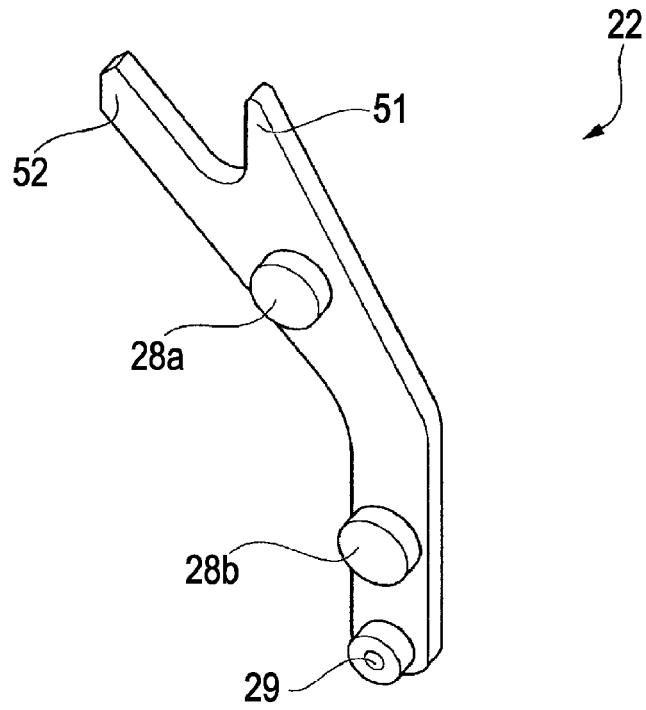
FIGS. 6A and 6B are diagrams illustrating the configuration of a position regulation arm, where
Figure 6B:
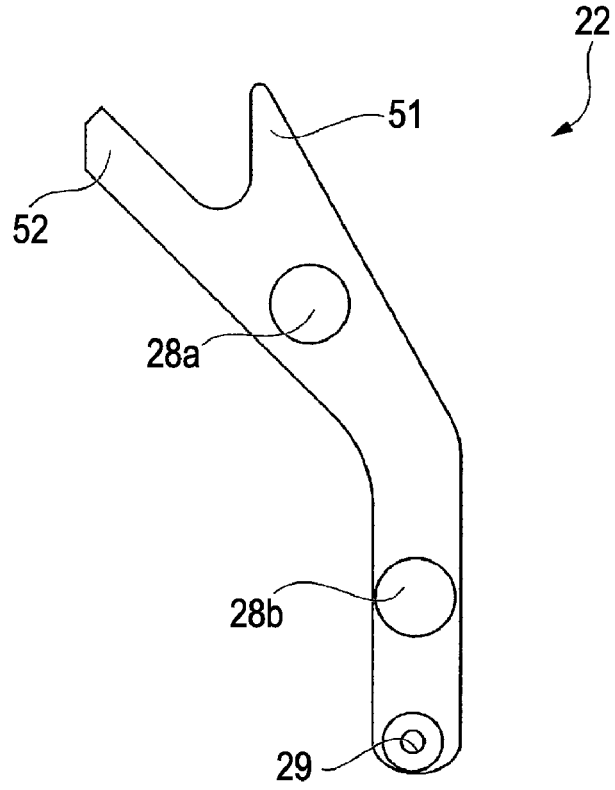

The position regulation arm 22 is, as shown in FIGS. 6A and 6B, an approximately Y-shaped member in which two branches are formed at one end; two bosses 28*a* and 28*b* that interlock with the cam grooves 24*a* and 24*b*, respectively, are formed in the surface of the position regulation arm 22 on the side that opposes the surface of the anchoring member 21 in which the cam grooves 24*a* and 24*b* are formed, and furthermore, on the other end of the position regulation arm 22, a cylindrical portion 29 having an attachment hole 29*a* for attaching the other end of the biasing spring 23 is formed.

The end on which the two branches are formed is configured of a first arm (pressure portion) 51 and a second arm (pressure portion) 52. The first arm 51, as shown in FIG. 4A, presses the pressure receiving portion 40 of the medium path unit 30 in the direction of the arrow in FIG. 4A, or in other words, in the direction by which the medium path unit 30 is mounted in the printer main body 2. Meanwhile, the second arm 52, as shown in FIG. 4B, presses the pressure receiving portion 40 of the medium path unit 30 in the direction of the arrow in FIG. 4B, or in other words, in the direction by which the medium path unit 30 is removed from the printer main body 2.

Note that the first arm 51 has a thinner tip and is formed so as to be shorter than the second arm 52. When the medium path unit 30 is removed from the printer main body 2, the pressure receiving portion 40 passes above the first arm 51, as shown in FIG. 4B; the formation of the first arm 51 ensures that this passage will not be interfered with.

In addition, the position regulation arm 22 is formed in a bent shape that generally resembles a "right dog-leg", between the end in which the first arm 51 and the second arm 52 are formed and the other end in which the attachment hole 29*a* is formed.

The anchoring member 21 and the position regulation arm 22 configured in this manner are attached to each other with the boss 28*a* interlocking with the cam groove 24*a* of the anchoring member 21 and the boss 28*b* interlocking with the cam groove 24*b*, in a mobile state, respectively, as shown in FIGS. 4A and 4B. The biasing spring 23, which is a torsion spring, is attached in this state. In other words, one end 23*b* of the biasing spring 23 is attached to the attachment hole 27 of the anchoring member 21, whereas the other end 23*a* is attached to the attachment hole 29*a* of the position regulation arm 22.

At this time, the lower area of the anchoring member 21 in which the attachment hole 27 is formed has a step relative to the upper area of the anchoring member 21 to which the position regulation arm 22 is attached, and thus the thickness of the coil section of the torsion spring (biasing spring 23) is accommodated, along with the thickness (height) of the cylindrical portion 29, by that step. Accordingly, the one end 23*a* of the biasing spring 23 extends along the surface of the cylindrical portion 29 of the position regulation arm 22 and then curves, thus passing through the interior of the attachment hole 29*a*, and is attached thereto. Meanwhile, the other end 23*b* of the biasing spring 23 extends along the surface of the anchoring member 21 and then curves, thus passing through the interior of the attachment hole 27, and is attached thereto.

The cam grooves 24*a* and 24*b* are, as shown in FIGS. 4A and 4B, each formed in a curved state, and the bosses 28*a* and 28*b* interlock with the cam grooves 24*a* and 24*b*, respectively, in a mobile state. The cam mechanism according to this embodiment is formed by the two pairs of cam grooves 24*a* and 24*b* and bosses 28*a* and 28*b*.

The configuration is such that as a result of such a cam mechanism, the one end and other end of the position regulation arm 22 displace in directions opposite to each other, and the position regulation arm 22 as a whole pivots in the forward and reverse directions relative to the anchoring member 21. In other words, the bosses 28*a* and 28*b* move within the cam grooves 24*a* and 24*b*, respectively, in different directions, and as a result, the position regulation arm 22 pivots as a whole.

When the position regulation arm 22 is moved relative to the anchoring member 21 from a first position to a second position or from the second position to the first position, the biasing spring 23 elastically deforms, and then elastically restitutes after passing an inversion point, thus biasing the position regulation arm 22 in the direction of that movement.

In other words, assuming that the position of the position regulation arm 22 relative to the anchoring member 21 when the medium path unit 30 is removed from the printer main body 2, as shown in FIG. 4B, is the first position, and the position of the position regulation arm 22 relative to the anchoring member 21 when the medium path unit 30 is mounted in the printer main body 2, as shown in FIG. 4A, is the second position, the biasing spring 23 is configured so as to bias the position regulation arm 22 so that the one end 23*a* and the other end 23*b* open relative to each other in the first position and the second position.

Here, in the first position illustrated in FIG. 4B, the boss 28*a* is positioned at the left end of the cam groove 24*a* and thus cannot move any further to the left, and the boss 28*b* is positioned at the right end of the cam groove 24*b* and thus cannot move any further to the right. Accordingly, the end of the position regulation arm 22 in which the first arm 51 and the second arm 52 are formed cannot pivot toward the left direction illustrated in FIG. 4B. Furthermore, the biasing spring 23 biases the position regulation arm 22 in the direction in which the one end 23*a* and the other end 23*b* open relative to each other, as mentioned earlier, and thus an end of the position regulation arm 22 is biased to the left in FIG. 4B.

Meanwhile, in the second position illustrated in FIG. 4A, the boss 28*a* is positioned at the right end of the cam groove 24*a* and thus cannot move any further to the right, and the boss 28*b* is positioned at the left end of the cam groove 24*b* and thus cannot move any further to the left. Accordingly, the end of the position regulation arm 22 in which the first arm 51 and the second arm 52 are formed cannot pivot toward the right direction illustrated in FIG. 4A. Furthermore, the biasing spring 23 biases the position regulation arm 22 in the direction in which the one end 23*a* and the other end 23*b* open relative to each other, as mentioned earlier, and thus the end of the position regulation arm 22 is biased to the right in FIG. 4A.

Meanwhile, as will be discussed later, when an external force is applied to the position regulation arm 22 via the medium path unit 30 and the position regulation arm 22 has been moved from the first position (the position illustrated in FIG. 4B) to the second position (the position illustrated in FIG. 4A) or vice versa, the biasing spring 23 elastically deforms in accordance with the movement of the attachment hole 29*a* so that the one end 23*a* and the other end 23*b* close relative to each other (approach each other); after passing the inversion point thereof, the biasing spring 23 elastically restitutes, and the one end 23*a* and the other end 23*b* once again open relative to each other.

At that time, the position regulation member 20 biases the position regulation arm 22 relative to the anchoring member 21 particularly when the one end 23*a* and the other end 23*b* open relative to each other due to the elastic restitution from the closed state, and thus the pressure receiving portion 40 of the medium path unit 30, which makes contact with the position regulation arm 22, is strongly pressed thereby.

Note that the position of the attachment hole 29*a* also moves due to the movement of the position regulation arm 22, and as a result, the distance between the one end 23*a* and the other end 23*b* of the biasing spring 23 changes; however, the position at which that distance is the smallest, or a position in that vicinity, is the aforementioned inversion point. As discussed earlier, the biasing spring 23, which is a torsion spring, is biased by the coil section thereof in the direction in which the one end 23*a* and the other end 23*b* open relative to each other, and thus when an external force is exerted in the direction in which the one end 23*a* and the other end 23*b* close, the reactive force thereto increases. Accordingly, as described earlier, when the distance between the one end 23*a* and the other end 23*b* of the biasing spring 23 reaches a minimum and an external force is slightly exerted in the direction that opens those ends, elastic restitution that further opens the one end 23*a* and the other end 23*b* occurs. Accordingly, the position that corresponds to this state is the inversion point at which the one end 23*a* and the other end 23*b* move from a closed state to an opened state.

Meanwhile, the position regulation member 20 configured in this manner is attached and anchored to a predetermined location within the printer main body 2 by the attachment interlocking protrusion 26 of the anchoring member 21, as shown in FIG. 2. At that time, the first arm 51 and the second arm 52 of the position regulation arm 22 are disposed on either side of the pressure receiving portion 40 of the medium path unit 30.

Next, operations for mounting and removing the medium path unit 30 will be described.

When the printer 1 is in use or standing by, the medium path unit 30 is mounted in a housing unit (not shown) of the printer main body 2, as shown in FIG. 4A. At this time, the positioning concave portions 39 of the medium path unit 30 makes contact and interlocks with the positioning members 45 provided in predetermined locations in the printer main body 2, as shown in FIG. 2.

Meanwhile, the medium path unit 30 is biased in the mounting direction by the position regulation member 20, as indicated by the arrow in FIG. 4A, and thus the contact and interlock of the positioning concave portions 39 with the positioning members 45 is reinforced. Accordingly, even if there is, for example, a margin provided for the various components, no looseness occurs between the positioning concave portions 39 and the positioning members 45, as did in the past; as a result, the medium path unit 30 is strongly anchored to the printer main body 2 without any looseness.

Figure 7:
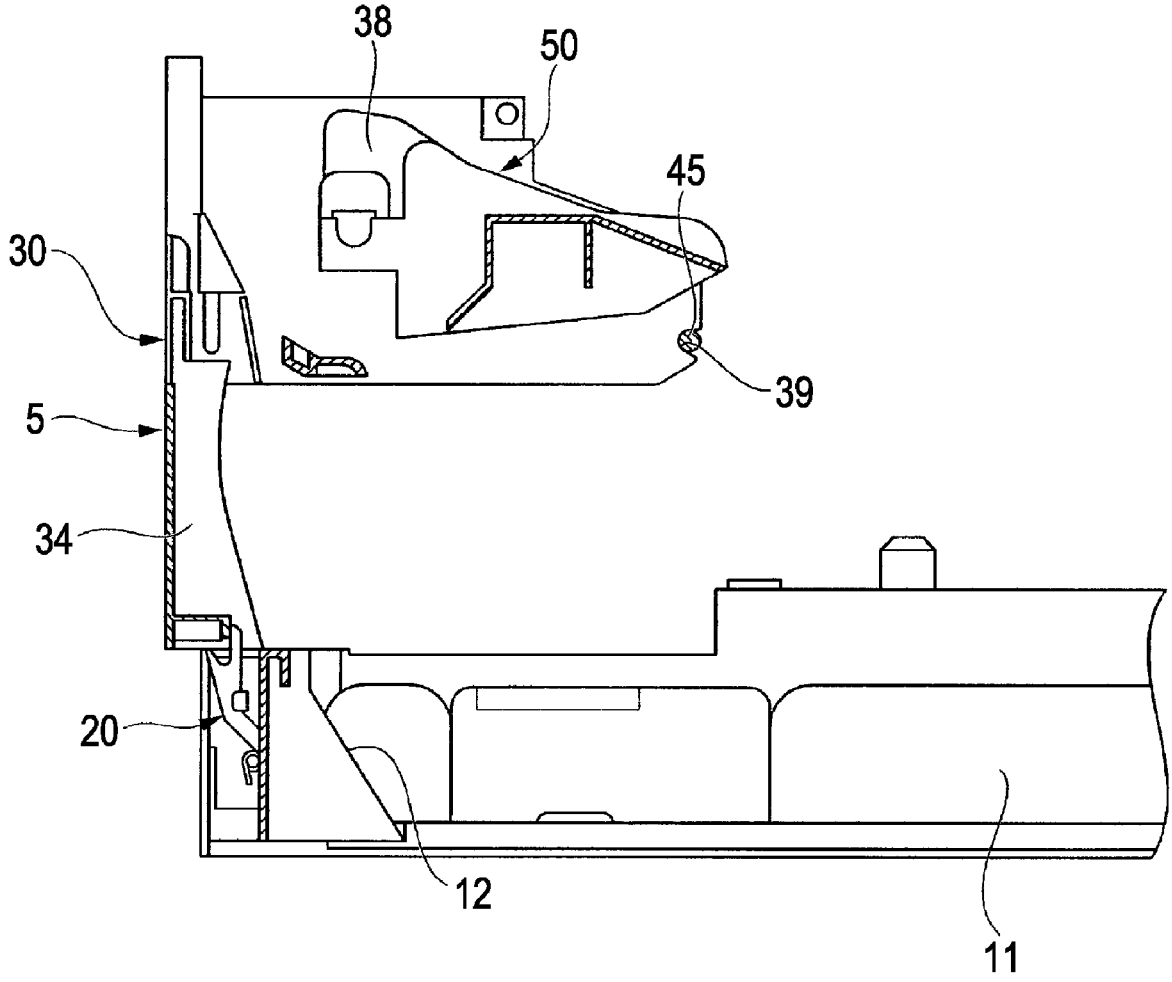
FIG. 7 is a cross-sectional view illustrating the overall configuration of the main internal structural elements of the printer illustrated in FIG. 1, as seen from the side.
Figure 8A:
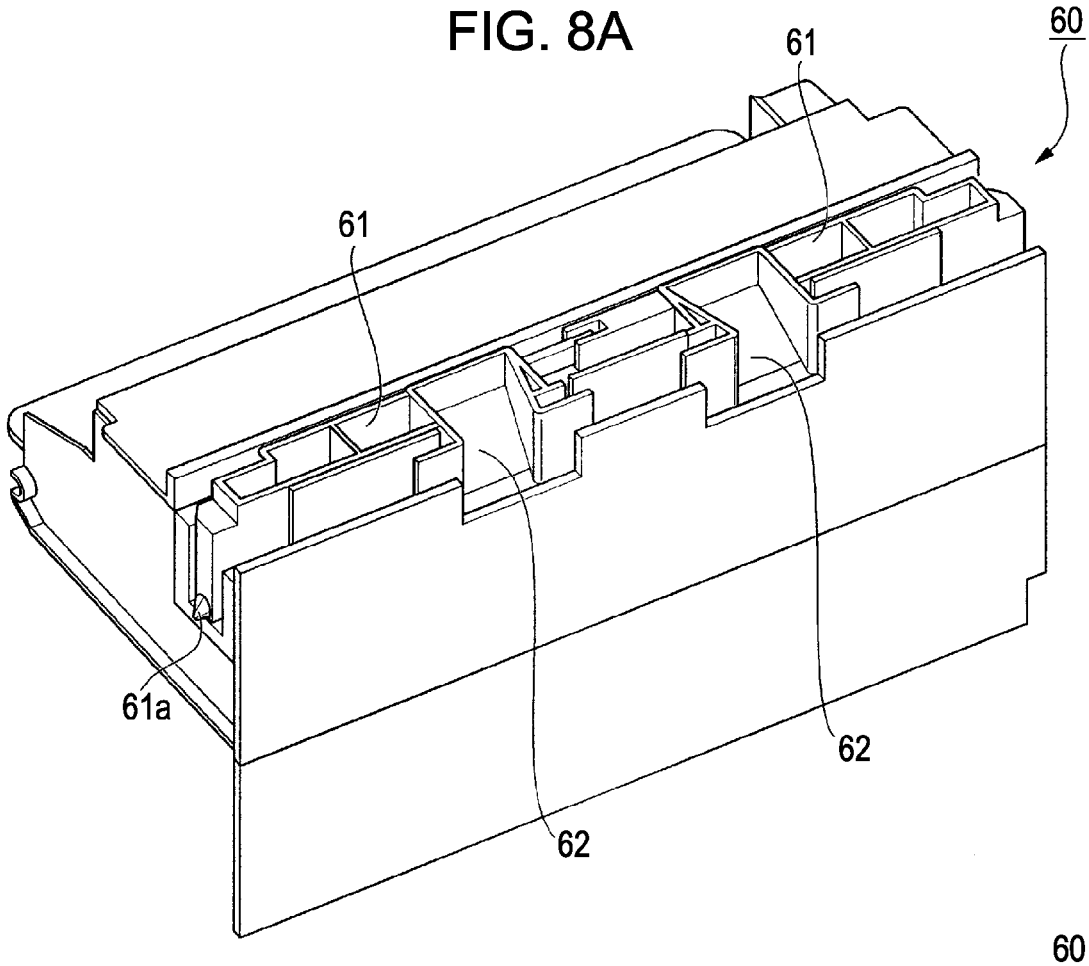
FIGS. 8A and 8B are diagrams illustrating an example of a past medium path unit.
Figure 8B:
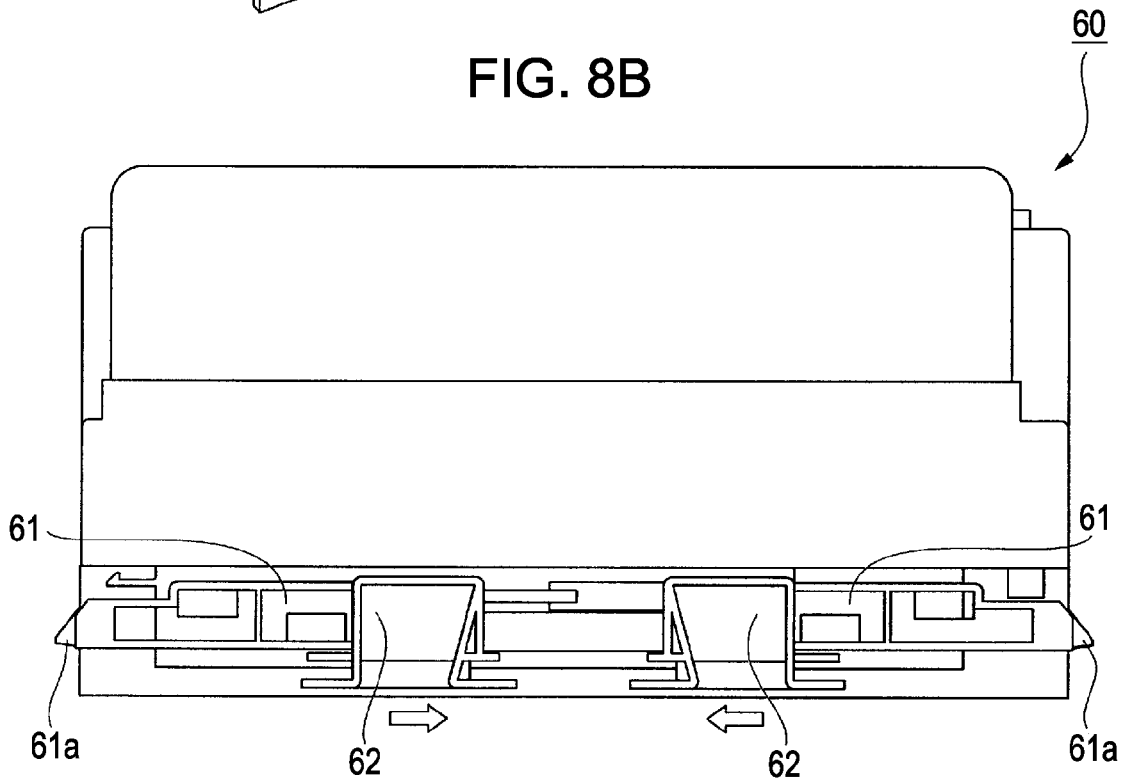

In the case where the medium path unit 30 is removed from the printer main body 2 from such a mounted state in order to, for example, perform maintenance, the medium path unit 30 can be removed from the printer main body 2 with ease as illustrated in FIG. 7 simply by pulling the medium path unit 30 out, without performing unlocking operations by pushing in tab portions 62 as in the past example illustrated in FIG. 8. At this time, in the initial stage of pulling the medium path unit 30 out, the pressure receiving portion 40 of the medium path unit 30 is pressed by the first arm 51 of the position regulation arm 22 of the position regulation member 20 as shown in FIG. 4A, and thus a force capable of pulling the medium path unit 30 out against the biasing force (pressure) of the position regulation member 20, or in other words, the biasing force (pressure) of the biasing spring 23, is necessary.

However, when the medium path unit 30 is pulled out to a certain extent and the inversion point of the biasing spring 23 is passed, the biasing spring 23 biases the medium path unit 30 in the removal direction (pull-out direction) indicated by the arrow in FIG. 4B due to the elastic restitution of the biasing spring 23. Accordingly, the operations for pulling out and removing the medium path unit 30 are extremely smooth.

Note that when pulling out (removing) the medium path unit 30 in this manner, the first arm 51 drops due to the pivoting of the position regulation arm 22 of the position regulation member 20, and thus the movement of the pressure receiving portion 40 resulting from the movement of the medium path unit 30 is not obstructed.

In addition, when the medium path unit 30 is removed as illustrated in FIG. 4B, the position regulation arm 22 on the side of the biasing spring 23 pivots to the right in FIG. 4B, thus interlocking with the holding portion 25 and being held thereby. Accordingly, even if the second arm 52 of the position regulation arm 22 is pulled irregularly due to erroneous operations or the like from this state, a problem in which the position regulation arm 22 falls from the anchoring member 21 is prevented.

In the case where the medium path unit 30 is to be remounted in the printer main body 2 after the maintenance has been finished, the medium path unit 30 is inserted into the holding unit (not shown) of the printer main body 2 and the pressure receiving portion 40 is brought into contact with the second arm 52 of the position regulation member 20, as shown in FIGS. 2 and 4B. Then, the medium path unit 30 is mounted in the holding unit (not shown) of the printer main body 2 simply by pushing on the medium path unit 30 in that state. At this time, in the initial stage of pushing the medium path unit 30 in, the pressure receiving portion 40 of the medium path unit 30 is pressed by the second arm 52 of the position regulation arm 22 of the position regulation member 20 as shown in FIG. 4B, and thus a force capable of pushing the medium path unit 30 in against the biasing force (pressure) of the position regulation member 20, or in other words, the biasing force (pressure) of the biasing spring 23, is necessary.

However, when the medium path unit 30 is pushed in to a certain extent and the inversion point of the biasing spring 23 is passed, the biasing spring 23 biases the medium path unit 30 in the mounting direction (push-in direction) indicated by the arrow in FIG. 4A due to the elastic restitution of the biasing spring 23. Accordingly, the operations for pushing in and mounting the medium path unit 30 are extremely smooth.

In addition, when the medium path unit 30 is mounted in the printer main body 2 in this manner, the positioning concave portions 39 of the medium path unit 30 make contact and interlock with the positioning members 45 as described earlier. In this state, the position regulation member 20 biases the pressure receiving portion 40 in the mounting direction, indicated by the arrow in FIG. 4A, through the first arm 51 of the position regulation arm 22. Accordingly, by being biased by the position regulation member 20 in this manner, the medium path unit 30 is securely anchored to the printer main body 2, with no looseness.

With the position regulation member 20 configured in this manner, the configuration is such that when the position regulation arm 22 moves from the first position to the second position or vice versa, the biasing spring 23 biases the position regulation arm 22 in the direction of the movement, and thus in the case where the medium path unit 30 is positioned in a predetermined location in the printer main body 2 using the position regulation member 20, the medium path unit 30 can be anchored to the predetermined location with no looseness by the biasing spring 23 biasing the medium path unit 30 through the position regulation arm 22 while the medium path unit 30 is positioned in the predetermined location. Accordingly, a drop in the recording precision (printing precision) on the recording medium caused by looseness can be suppressed.

In addition, when removing the medium path unit 30 that is anchored to the predetermined location in this manner, the medium path unit 30 can be removed with ease simply by pulling the medium path unit 30 out in the direction opposite to the direction in which the medium path unit 30 was mounted. Furthermore, the configuration is such that at this time, the biasing spring 23 biases the position regulation arm 22 in the direction of the movement thereof, and thus after the inversion point has been passed, the biasing spring 23 biases the medium path unit 30 in the removal direction; this makes it possible to remove the medium path unit 30 smoothly.

Furthermore, because the position regulation arm 22 has two branches on either side of the pressure receiving portion 40, or the first arm 51 and the second arm 52, the pressure receiving portion 40 can be moved from the first position to the second position by one of the arms 51 and 52 and from the second position to the first position by the other of the arms 51 and 52. Accordingly, the pressure receiving portion 40 can be advanced/retracted using a simple configuration.

Furthermore, because the cam mechanism is configured of two cam pairs, or the cam grooves 24*a* and 24*b* and the bosses 28*a* and 28*b* that interlock in a mobile state with the cam grooves 24*a* and 24*b* respectively, and thus the operation of the position regulation arm 22 relative to the anchoring member 21 is regulated by the two cam pairs. Accordingly, the level of freedom with which the position regulation arm 22 moves is reduced, wasteful movement is eliminated, and the position regulation arm 22 moves relative to the anchoring member 21 as designed.

Furthermore, because the position regulation arm 22 is formed in a bent shape that generally resembles a "right dog-leg", between the end in which the first arm 51 and the second arm 52 are formed and the end in which the one end 23*a* of the biasing spring 23 is attached, the pivot stroke of the position regulation arm 22 can be increased while suppressing the overall movement range of the position regulation arm 22 relative to the anchoring member 21. Accordingly, the size of the position regulation member 20 can be reduced.

Furthermore, with the transport apparatus 5 that includes the medium path unit 30 provided so as to be removable from the printer main body 2 and that further includes the position regulation member 20 that positions the medium path unit 30, the medium path unit 30 can be anchored to the predetermined location without looseness, as mentioned earlier; thus a drop in the recording precision (printing precision) on the recording medium can be suppressed. Furthermore, the medium path unit 30 can be removed smoothly and with ease simply by pulling (moving) the medium path unit 30 out in the direction opposite to the direction in which the medium path unit 30 is mounted.

Furthermore, because the pressure receiving portion 40 of the medium path unit 30 is disposed in the central area of the direction that is perpendicular to the transport direction of the recording medium (recording paper) in the medium path unit 30, that central area is pressed and anchored by the position regulation member 20 while the medium path unit 30 is mounted in the printer main body 2. Accordingly, by anchoring the central area in the width direction that is perpendicular to the transport direction of the recording medium held in the medium path unit 30, skew in the recording medium discharged from the medium path unit 30 can be prevented with more certainty.

Note that the invention is not limited to the above embodiment, and many variations are possible without departing from the essential spirit of the invention.

For example, although the position regulation member according to the invention was used for positioning the medium path unit 30 (removable unit) provided in the printer main body (base unit) in a removable state in the aforementioned embodiment, the position regulation member can also be used for, for example, positioning a paper feed cassette.

Furthermore, although the cam mechanism in the position regulation member is configured of two cam pairs in the aforementioned embodiment, the cam mechanism configuration is not limited to the configuration illustrated in FIGS. 4A and 4B, and various configurations can be employed as long as the position regulation arm can move from the first position to the second position relative to the anchoring member.

Finally, multiple position regulation members 20 can be disposed in the printer main body 2 (base unit), the medium path unit 30 (removable unit), and so on, instead of just one. For example, pressure receiving portions 40 may be formed on both sides of the medium path unit 30 (in areas near the respective side plates 37 and 37), and two position regulation members 20 may then be provided corresponding to the pressure receiving portions 40. Providing two (multiple) position regulation members 20 makes it possible to even more strongly anchor the medium path unit 30 to the predetermined location without looseness.

What is claimed is:

1. A position regulation member, provided in one of a base unit and a removable unit that is attached to the base unit in a removable state, that positions the removable unit relative to the base unit, the position regulation member comprising:

a position regulation arm provided so as to be mobile between a first position and a second position through the use of a cam mechanism; and a biasing spring attached to the position regulation arm, wherein when the position regulation arm is moved from the first position to the second position or from the second position to the first position, the biasing spring biases the position regulation arm in the direction of the movement of the position regulation arm by first elastically deforming and then switch the direction of biasing by passing a inversion point.

2. The position regulation member according to claim 1, wherein the position regulation arm includes a pressure portion provided in the other of the base unit or the removable unit, the pressure portion having two branches that sandwich a pressure receiving portion.

3. The position regulation member according to claim 2, wherein the cam mechanism is configured so as to include two cams, each cam being configured of a cam groove and a boss that interlocks with the cam groove in a mobile state.

4. The position regulation member according to claim 3, wherein one end of the biasing spring is attached to the opposite side of the position regulation arm as the side that makes contact with the other of the base unit or the removable unit, and the position regulation arm is formed in a shape that is bent between the side that makes contact with the other of the base unit or the removable unit and the side to which the one end of the biasing spring is attached.

5. A transport apparatus comprising a medium path unit that is provided so as to be removable from a base member, wherein the medium path unit is provided with a pressure receiving portion and a positioning unit that positions the medium path unit relative to the base member by making contact with a predetermined location of the base member;

the base member is provided with the position regulation member according to claim 1; and the position regulation member is disposed so as to press the pressure portion using the position regulation arm so that the first position and the second position correspond to a position in which the medium path unit is removed from the base member and a position in which the positioning unit is brought into contact with the predetermined location respectively.

6. The transport apparatus according to claim 5, wherein the pressure receiving portion is disposed in the center of the medium path unit in the direction that is perpendicular to the transport direction of a medium.

* * * * *